United States Patent [19]

Matheny et al.

[11] 4,415,159

[45] Nov. 15, 1983

[54] GOLF STANCE VIEWER

[76] Inventors: Paul Matheny; Frances V. Matheny, both of 6491 Fox Run Cir., Jupiter, Fla. 33458

[21] Appl. No.: 304,026

[22] Filed: Sep. 21, 1981

[51] Int. Cl.[3] ..... A63B 69/36

[52] U.S. Cl. ..... 273/187 A; 33/262; 273/35 A

[58] Field of Search ..... 273/163 R, 163 A, 32 H, 273/187 R, 187 A, 35 A; 434/90, 91, 252; 33/262, 370

[56] References Cited

U.S. PATENT DOCUMENTS

| | | | |
|---|---|---|---|
| 2,164,463 | 7/1939 | Mather | 33/262 |
| 2,497,360 | 2/1950 | Justice | 434/90 X |
| 2,796,666 | 6/1957 | Liebowitz | 434/90 X |
| 3,096,587 | 7/1963 | Kenney | 434/90 X |
| 3,870,299 | 3/1975 | Howe | 273/32 H |
| 4,158,259 | 6/1979 | Hansen et al. | 33/262 |
| 4,193,594 | 3/1980 | Schwauss | 434/261 X |
| 4,260,151 | 4/1981 | Weaver | 273/32 H |

FOREIGN PATENT DOCUMENTS

| | | | |
|---|---|---|---|
| 430844 | 6/1935 | United Kingdom | 273/163 R |

*Primary Examiner*—George J. Marlo
*Attorney, Agent, or Firm*—Jack N. McCarthy

[57] ABSTRACT

A golf stance viewer having a lens for looking at the positioning of one's feet and golf ball, said lens having stance indicating lines associated therewith for indicating foot and golf ball placement; a leveling device being provided to place said viewer in a desired plane and a reflecting device, such as a mirror, to aim the viewer in a specific direction. A support being provided to place the viewing device at the same desired position in relation to the golfer time after time. To determine a proper stance, a golf club swing marking device indicates the arcuate path of a golf club which has been swung, and a golf ball impact recording device indicates the point of impact where a club face hits a golf ball.

16 Claims, 14 Drawing Figures

FIG 13
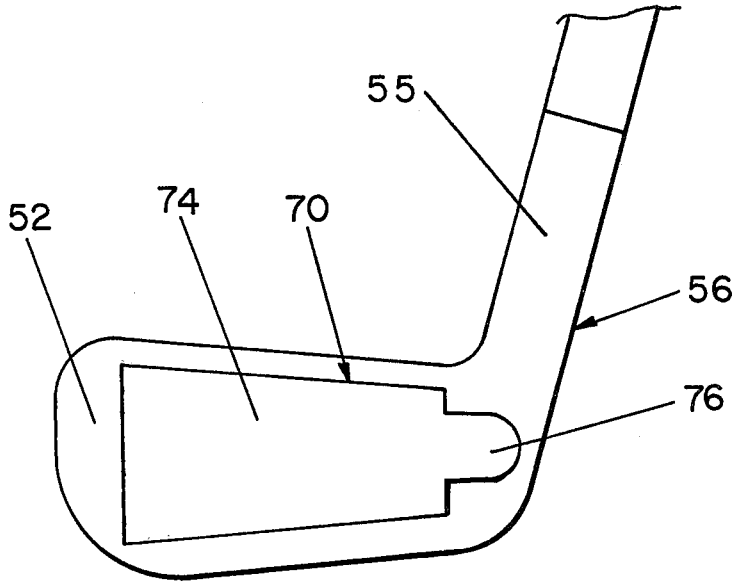
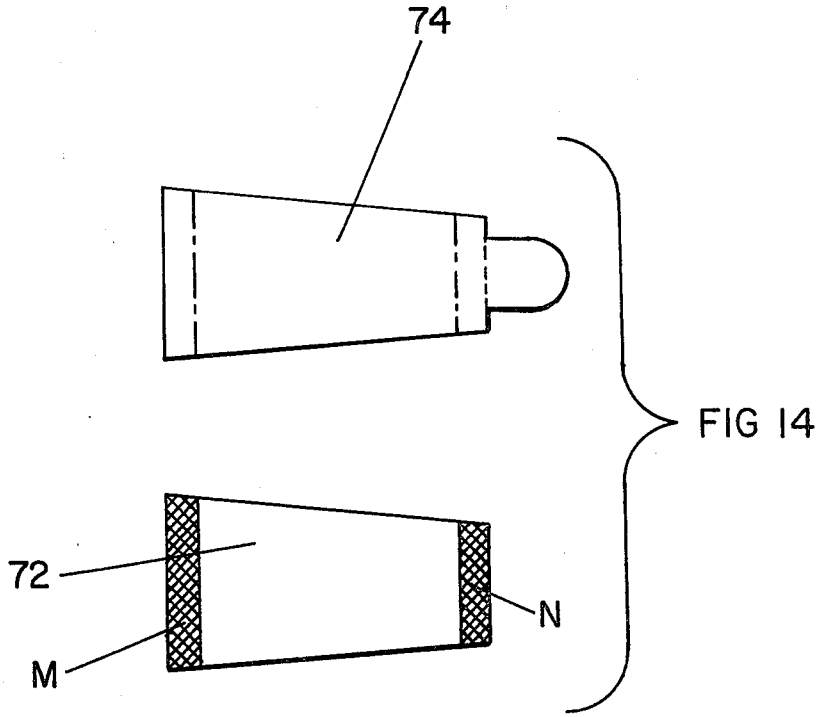
FIG 14

GOLF STANCE VIEWER

TECHNICAL FIELD

This invention relates to a device for improving a golf player's game and more particularly to a viewing device for showing the golfer where his feet are with respect to a golf ball to be hit.

BACKGROUND ART

A number of devices to aid a golfer in locating his feet with respect to a golf ball have been shown in the prior art. Such devices generally include mechanical ruler type parts that lie on the ground and give feet and ball locating markers. These devices are limited in what they can do and are very cumbersome. Some of these devices are shown in the following U.S. patents: U.S. Pat. Nos. 2,777,697; 3,141,675; 3,253,830 and 3,658,344. A viewer designed to be attached to a golf club is shown in U.S. Pat. No. 1,556,062 and U.S. Pat. No. 3,118,678. These patents appear to be only used as aids in putting. Golf clubs have also been used having a level device on the head of the club or on the club shaft. Of these, two are shown in U.S. Pat. Nos. 3,909,004 and 4,079,520. Here again, these devices are on the golf club and do not aid in a device for locating a golf stance.

U.S. Pat. No. 3,684,294 shows means for placing a stance diagram where it can be seen by a user to place his feet in a desired relationship with a golf ball to be hit. None of the above art discloses applicants' invention.

DISCLOSURE OF INVENTION

It is an object of this invention to provide a viewing device for (1) permitting a golfer to record the proper position for placing his feet in relation to a golf ball for each club he uses, and after the proper stance has been recorded, (2) permitting a golfer to place his feet in relation to a golf ball in the proper position recorded for each club he uses whenever he desires.

Another object of this invention is to provide a viewing device for improving the consistency of play of a golfer by permitting a golfer to align his feet with a golf ball in a predetermined stance and in a desired direction for similar golf ball locations, such as on a tee, on the fairway, etc.

It is another object of this invention to provide a stance indicator between the golfer's eye and the ground, including the ball and the golfer's feet, so that the golfer's feet can be placed in relation to the ball, as previously recorded, with an optical direction finder being provided to directionally position the viewing device, if desired; leveling means are provided to aid in positioning the stance indicator.

Another object of this viewing device is that it allows novice or experienced golfers to align themselves properly with a golf ball in accordance with a recorded stance position and then store the device without loss or change of position and without interference with one's stroke.

Another object of the present invention is to provide a viewing device for golf teachers to use in teaching golf students so that they can assume the most effective stance with a golf ball which has been determined by instruction and practice. This device will aid in making small corrections in one's stance and allow the golfer to practice without a teacher to assist him, as from an instruction book.

A further object of the invention is to provide a hand held portion so that a golfer can hold the viewing device at a desired position with respect to his body; supporting means being provided so that the viewing device can be easily placed at the same desired position time after time; said supporting means can include an adjustment so that the viewing device can be used by different golfers wherein the desired position for locating the viewing device is different.

Another object of the invention is to provide a viewing device including a viewing lens through which a golfer can look and see his feet and the golf ball to be hit, an indicating means being aligned with said lens comprising a stance indicator which is superimposed over the golfer's feet and golf ball to be hit.

A further object of this invention is to provide a golf club swing marking device, which can be attached to the lower part of the golf club shaft having a flexible rod extension to make a mark on the ground or on carpet-type material. When using this device, a track will be formed, indicating how the arcuate path of the golf club passed by the golf ball location, said location being recorded so that it can be determined after the golf ball has been hit.

Another object of this invention is to provide a golf ball impact recording device which can be attached to the face of a golf club to ascertain where the golf ball is striking the face; this device comprises a multiple layer tape which is placed on the face of a golf club, one tape receiving the impact of the golf ball while another tape records the point of impact.

BRIEF DESCRIPTION OF DRAWINGS

FIG. 13 is a view of the lower portion of a golf club showing an impact recording tape placed on the face of a golf club; and FIG. 14 is an exploded view of the impact recording tape.

BEST MODE FOR CARRYING OUT THE INVENTION

Figure 1:
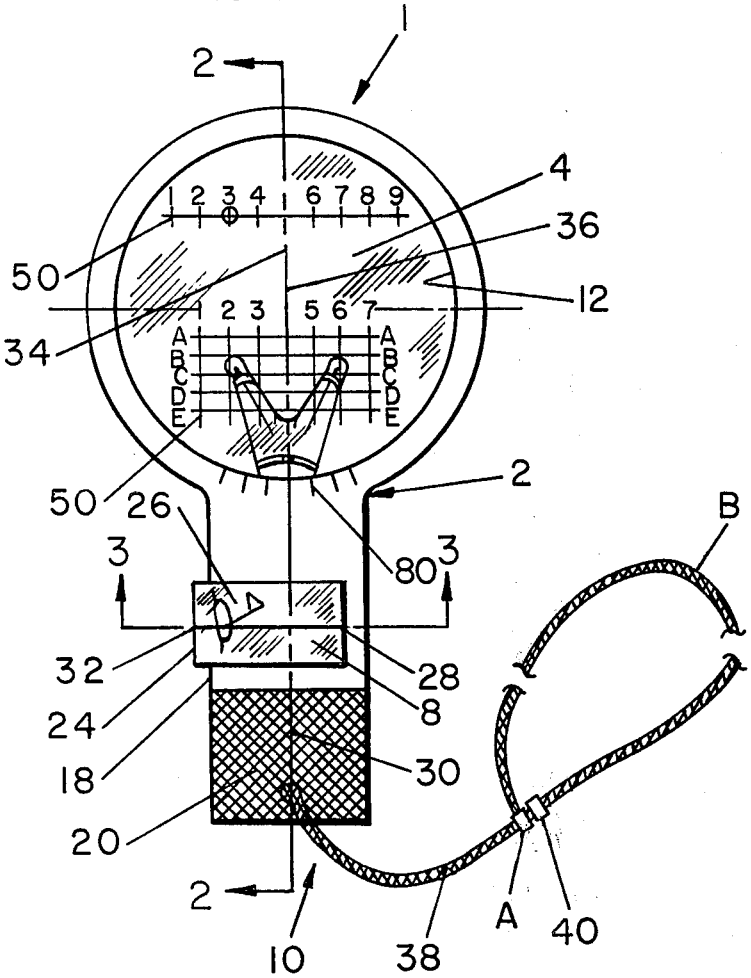
FIG. 1 is a top view of the viewing device including the supporting means and showing a stance indicator over a golf ball and golfer's feet.
Figure 2:
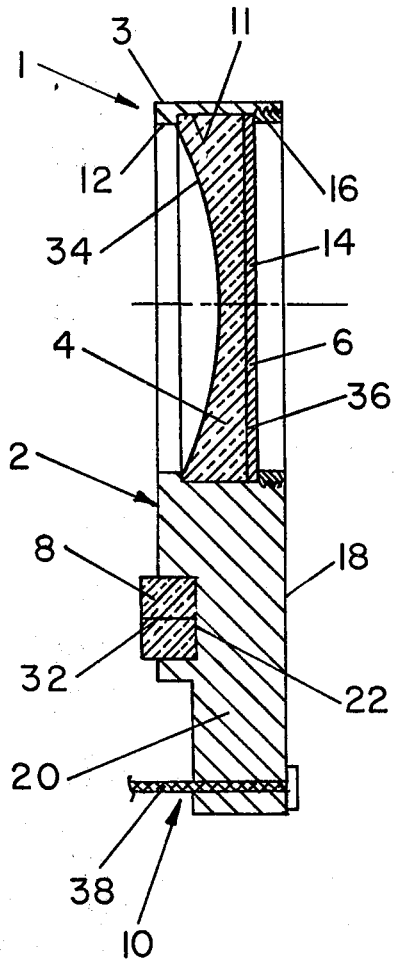
FIG. 2 is a view taken along the line 2—2 of FIG. 1.
Figure 3:
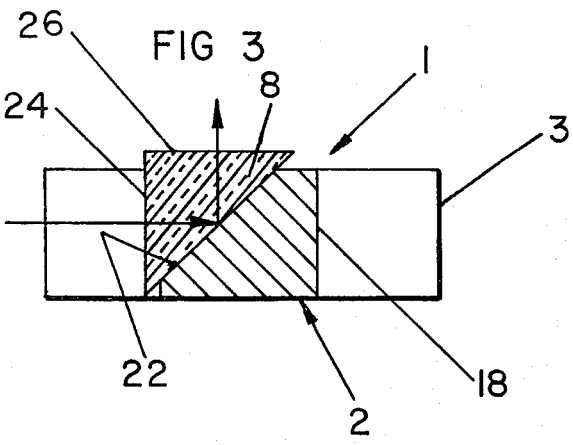
FIG. 3 is a view taken along the line 3—3 of FIG. 1.

As shown in FIGS. 1–3, the viewer, or viewing device, 1, for aligning a golfer's feet with respect to a golf ball and a desired direction of flight of said golf ball, includes five main parts: (1) a mounting means, or body, 2, having a top and bottom; (2) a circular viewing lens 4; (3) a stance indicator 6; (4) a reflective device 8; and (5) positioning means 10.

The mounting means, or body, 2, has a circular portion 3 at one end and this portion 3 of the mounting means, or body, 2, has a circular recess 11 in the bottom thereof to receive the circular viewing lens 4 and stance indicator 6. An opening 12 extends through the top of the enlarged end of the mounting means, or body, 2, into the circular recess 11 so that the viewing lens 4 can be seen by someone looking at the top of the mounting means, or body, 2. A circular stance indicator 6 comprising a circular transparent plate 14 (made of glass, plastic or any other transparent material) having stance indicating lines, or marks, 50 thereon, is positioned against the bottom of said circular viewing lens 4 in said recess 11 for a purpose to be hereinafter described, and a locking ring 16 is placed in said recess 11 against the outer circumference of said circular transparent plate 14 to hold the circular viewing lens 4 and said circular transparent plate 14 in place. While the outer edge of the locking ring 16 is shown threaded to engage threads in the recess 11, other locking, or holding, means can be used, such as a snap-ring, etc. The mounting means, or body, 2, has an arm 18 extending from the side of the circular portion 3. The free end of the arm 18 provides a hand, or finger, grip, 20, for one using the viewing device 1.

The reflective device 8 is fixed to the top of the arm 18 adjacent the circular portion 3 so that it can also be seen at the same time by someone looking at the viewing lens 4. The reflective device 8 is shown as a prism, said prism being fixed in a recess 22 in the arm 18. While the prism was glued in place in a construction made, it can be held in place by any known holding means. The prism has a rectangular objective surface 24 facing the object to be aimed at and a rectangular viewing surface 26 which is seen by the one using the viewing device 1. The plane of the viewing surface 26 is shown as parallel to the stance indicator 6 and at right angles to the center plane 30 of the viewing device 1, and the objective surface 24 is formed at right angles to the front edge of the viewing surface 26 (see FIGS. 1, 2 and 3).

The reflective device 8, while shown as a prism, can comprise a mirror placed at the proper angle in recess 22. The use of a mirror is shown in U.S. Pat. No. 1,556,062. A line 28 is placed at the center of the viewing surface 26 at right angles to the center plane 30 of the viewing device 1, and a line 32 is placed down the center of the objective surface 24, said lines 28 and 32 meeting where the viewing surface 26 and the objective surface 24 meet. A line 34 is placed on the top of lens 4 where the center plane 30 of the viewing device 1 intersects it, and a line 36 is placed along a stance indicator 6 to be positioned below said line 34 along a plane where the center line 30 of the viewing device 1 intersects it. It can be seen that when said viewing device 1 is placed directly over a golf ball to be viewed and when one's eye is placed directly over said viewing device, and lines 28 and 32 are aligned when viewed in the prism and lines 34 and 36 are aligned when viewed through the lens 4, said stance indicator 6 is level. Another means to level the stance indicator 6 of the viewing device 1 would be to position a level device on the mounting means, or body, 2. A level which could be used is shown in U.S. Pat. No. 3,909,004.

To aim the viewing device 1, the lines 28 and 32 of the reflective device 8 are aligned as one is looking through the viewing surface 26 and placed in line with the object being aimed at, such as a flag on a green; and the lines 34 and 36 are aligned one over the other when one then looks through lens 4 to properly place the stance indicator 6 in relation to the golf ball so one's feet can then be properly placed, as hereinafter described.

A support cord 38 has one end attached to the free end of the hand grip 20, while the other end of the support cord 38 has a sliding engagement with the center portion of the support cord 38 at A, providing for a loop B, which can be placed over one's head to rest around his neck, such as a noose. The location of a stop means 40 in the loop B of the cord 38 fixes the length that the free end of the hand grip 20 can be positioned from one's neck. As the other end of the support cord 38 slides along the support cord 38 at A, it will stop sliding when it reaches the stop means 40. The hand grip 20, along with the positioning means 10, support cord 38 and stop means 40, provides for placing the viewing device at a proper position.

Figure 4:
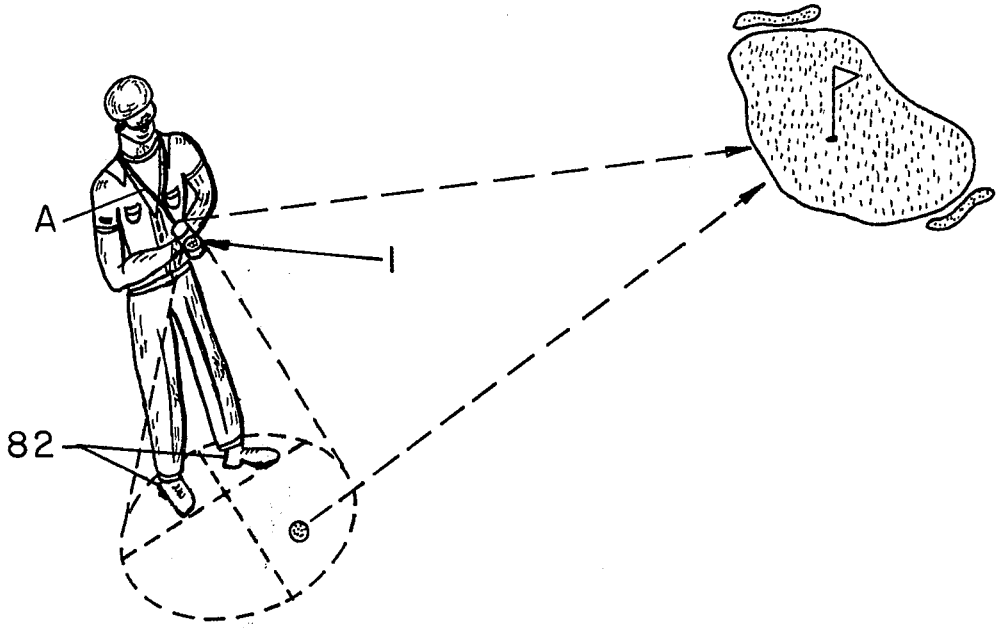
FIG. 4 is a view showing a golfer holding the viewing device in a desired position with respect to his feet and a golf ball to be hit while aligning the viewing device with a putting green.

As the golfer with his grip on hand grip 20 extends the cord for its full length as set by the stop means 40, the lens 4 and stance indicator 6 can be fixedly positioned between the golfer's eye and the location of the golfer's ball and feet on the ground. The viewing device 1 can be steadied and placed at substantially the same position each time of use by placing the free end of the arm 18 against the golfer's body or place the hand holding the arm 18 against the golfer's body. The lens 4 and stance indicator 6 can then have its angular position with respect to the ground controlled by the leveling means and can be aimed by the reflective device 8 (see FIG. 4).

The stop means 40 can be a metal grommet squeezed onto the support cord 38 or any other known means, including a knot in the cord 38. If the device is to be used by more than one golfer, the stop means 40 can be made adjustable so that the viewing device 1 can be placed at different positions, depending on the requirements of the golfer; this could become necessary if one golfer was very tall and the other golfer was very short. In this case, the stop means 40 could be a clamp which is slidable on the cord 38 and clamped to the cord 38 where desired. The desired positions on the cord 38 could be shown by a colored mark or ring, a different color being used for each player. The clamp could be a simple sleeve slidable on the cord 38 with a bolt threadably positioned through the side with the end within the sleeve wedging the cord in the sleeve while the end outside of the sleeve could have a butterfly grip so the bolt can easily wedge or release the cord. It is to be realized that any desired adjustable stop means 40 can be used.

Figure 5:
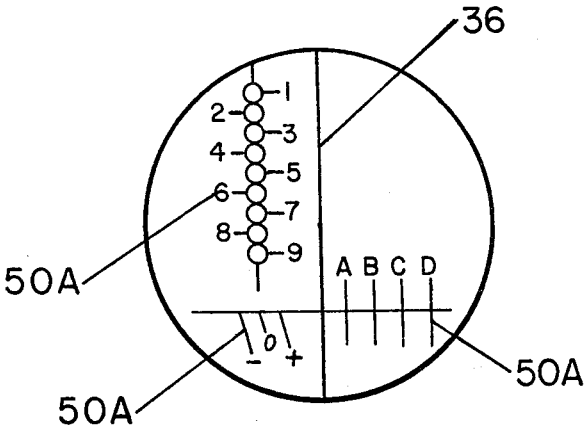
FIG. 5 is a view of a second stance indicator.
Figure 6:
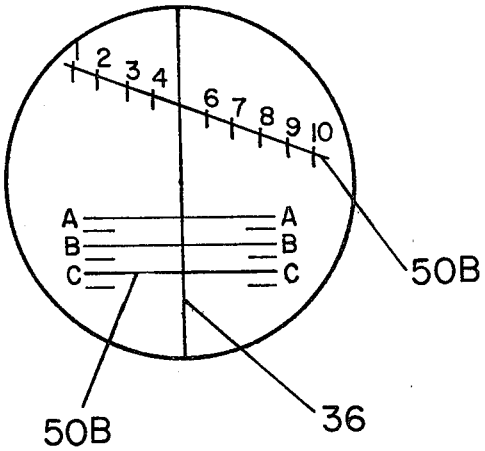
FIG. 6 is a view of a third stance indicator.
Figure 7:
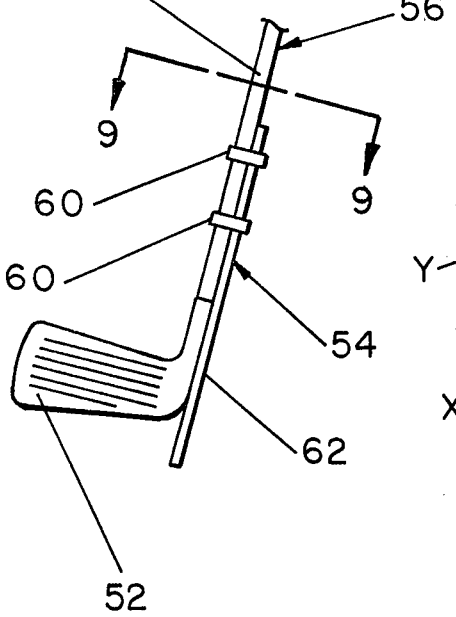
FIG. 7 is a view of the lower portion of a golf club showing the club face, with a swing marking device on the shaft thereof.

In FIG. 1, the circular transparent plate 14 is shown having stance indicating lines 50 thereon which are formed as nine (9) golf ball locating marks equally spaced on a line across the top numbered 1–9 and five (5 ) feet locating lines equally spaced across the bottom lettered A, B, C, D and E, with seven (7) crossing lines 1–7 forming a grid with the lines A–E. It is to be understood that other specific stance indicating lines, or marks, 50 can be used. Two other constructions are shown in FIGS. 5 and 6.

As shown in this Figure, the ball is located at ball indicating mark "3" and the golfer's feet are each located an equal distance on each side of center line 34, with each toe placed on line "B." This specific positioning of the feet with respect to a golf ball could be the optimum position for a golfer when using his 5-iron; so therefore, this specific stance information on the golf ball position and feet position shown, could be placed where a golfer could glance at it when he steps up to make a 5-iron shot. The information could take the form of a prepared stance diagram which would be a reproduction of the stance indicator 6 with the ball position and feet position shown thereon. The manner in which a prepared stance diagram can be displayed is set forth in U.S. Pat. No. 3,684,294. The information could also take the form of a written notation such as "5-IRON; BALL 3; LF B2; RF B6" indicating to the golfer, when the viewing device is held properly with "3" over the golf ball, for the 5-iron place the toe of the left foot on "B2" and the toe of the right foot on "B6."

It is to be realized that in a simple construction of the viewing device 1, the stance indicating lines or marks 50 can be etched directly onto, or placed on, the circular viewing lens 4. This would prevent the versatility of changing the stance indicating lines if desired. Means can also be provided for rotating circular viewing lens 4, or stance indicator 6, or both, if necessary, to place the stance indicating lines, or marks, 50, for a desired angular change of direction for given ball and feet positions. Angular marks 80 can be provided on the circular portion 3 on each side of line 34 to allow precise positioning. The marks can be placed at increments of 5°. Means can also be provided to place the circular viewing lens 4 and stance indicator 6 in a mechanically fixed position with respect to the circular recess 11. A notch could be placed on the periphery of the circular viewing lens 4 and stance indicator 6 and a projection could extend along the depth of the recess 11 to fit in said notch. A simple construction for placing the circular viewing lens 4 and stance indicator 6 in a fixed position would be to glue them in the circular recess 11, doing away with the need for the locking ring 16. To easily see and position one's feet through lens 4, shoes 82 having a contrasting color with the playing surface should be used—black or brown shoes if playing in snow. An indicating line could be placed on the upper surface of each shoe at its tip to provide for precise foot positioning with indicating lines, or marks, 50. FIGS. 5 and 6 show two other stance indicating lines, or marks, 50A and 50B, setting forth how the lines, or marks, can be tailored to a specific golfer.

To find out a desired stance for a particular club, a golfer can experiment by himself, using a golf instruction book if desired, or get instructions from a golf instructor.

Figure 8:
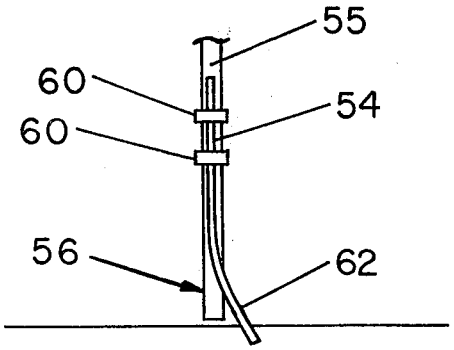
FIG. 8 is a view taken from the right of FIG. 7 showing the swing marking device having a flexible rod bent as in a swing to make a track.
Figure 10:
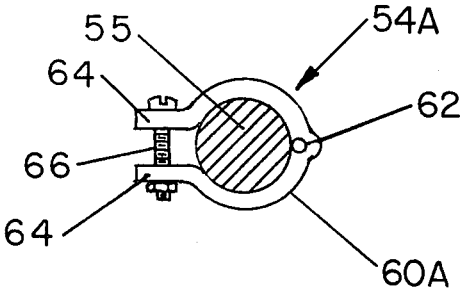
FIG. 10 is a view similar to FIG. 9 showing a modified holding means for the swing marking device.

To aid a golfer in determining the arc his club face 52 goes through as it contacts a golf ball, a swing marking device 54 can be attached to the lower part of the shaft 55 of the golf club 56 to make a mark on the ground or in carpet-type material 58 which will part when a flexible marking rod is passed through, leaving a track 59. Marking device 54 includes two spring clips 60 for holding a rod 62 to a shaft 55 which extends downwardly below the bottom of the club face 52. Rod 62, which can be made of plastic, or metal, must be stiff enough to mark the carpet-type material 58, or ground, and flexible enough to bend (see FIG. 8) and not affect the golfer's swing. To rigidly fix a rod 62 to a shaft 55 of a golf club 56, the two spring clips 60A can be made with flat ends 64 and a bolt 66 can be located between them for drawing the clips 60A tight around the shaft 55.

The carpet-like material 58 can have a circular area the size of a golf ball with the fibers colored a contrasting color. The material 58 could be green with a white circular area. A white disk having a circular area the same size could be fixed to the ground if the ground is used.

Figure 11:
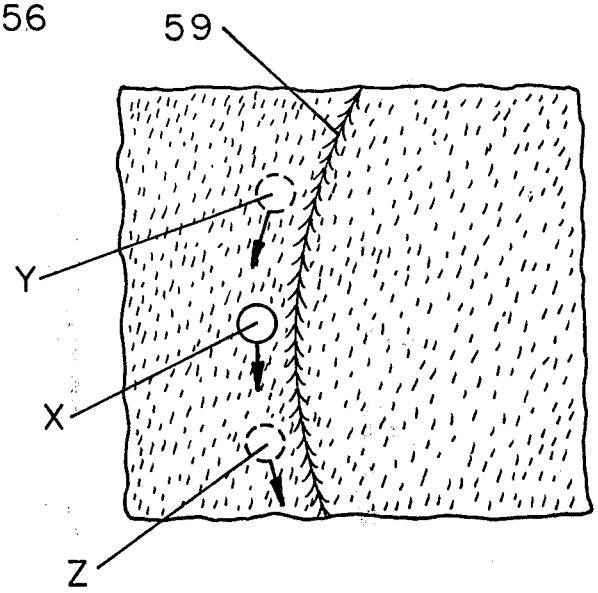
FIG. 11 is a section of carpet-like material having upwardly extending fibers which part and leave a track when a rod is passed through the fibers.
Figure 12:
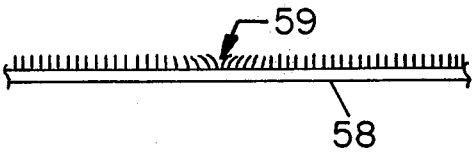
FIG. 12 is a side view of a part of FIG. 11 showing the track.
Figure 9:
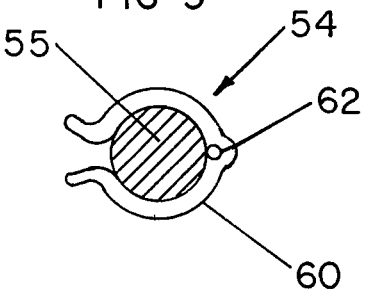
FIG. 9 is a view taken on the line 9—9 of FIG. 7.

A golf ball is placed on the circular area and a stance is taken and the ball is swung at; a look at the arcuate track 59, as seen in FIG. 11, will show how the swing passed the circular area. If the arcuate track 59 appears in relation to the circular area as shown by its relation to circular area X, then a square-faced club hit the golf ball to send it straight; if the arcuate track 59 appears in relation to the circular area as shown by its relation to dotted circular area Y, then a square-face club hit the ball to send it to the right; and if the arcuate track 59 appears in relation to the circular area as shown by its relation to dotted circular area Z, then a square-face club hit the golf ball to send it to the left. As the ball was actually hit, the golfer could see if this is the direction in which the golf ball went. However, it is to be remembered that other factors enter into ball direction and have to be taken into consideration in an attempt to find a proper stance.

To aid a golfer in determining where on the face 52 of his club 56 he is hitting the ball, an impact recording tape 70 can be used, said tape comprising two layers 72 and 74. Top layer 74 is made having a fabric-like construction to permit re-use, the underside of the top layer 74 is formed having a color which can be transferred to an adjacent bottom layer 72 having a contrasting color by impact. A preparation of carbon or ink can be placed on the underside of layer 74. If black ink is used, then a contrasting color for recording would be white. Bottom layer 72 has its underside made sticky to adhere to the face 52 of a golf club, its top surface is made a contrasting color to be used with the color on the underside of the layer 74. The top side of the bottom layer 72 is made sticky along each end at M and N to stick to the underside of the top layer 74 to keep the two layers of tape together. A tab 76 is provided on the end of layer 74 to easily peel it back and return it after the top surface of layer 72 has been cleaned off to receive another impact transfer. It can be seen that after the impact recording tape 70 is stuck onto the face 52 of a golf club 56, a golf ball struck will transfer the point of impact to the top surface of the bottom layer 72 through top layer 74. The top layer 74 can be peeled back by tab 76 and the point of impact observed. One's golf stance can be altered until a satisfactory impact can be consistently obtained, indicating a correct stance.

We claim:

1. A golf stance viewer including a mounting body, said mounting body having lens means therein to allow a golfer to look through said lens means and view his feet, said mounting body having a reflective device to aim in a desired direction away from said golfer while said lens means is positioned to view the golfer's feet, an indicating means comprising at least one feet indicating line so that as the golfer looks through said lens means said feet indicating line is viewed with the golfer's feet, said feet indicating line indicating feet placement therewith so that desired feet placement can be repeated.

2. A golf stance viewer as set forth in claim 1 wherein said lens means is a reducing one.

3. A golf stance viewer as set foth in claim 1 wherein said mounting body includes supporting means to support one part of said mounting body at a desired position with respect to a golfer when a golfer is looking through said lens means to see his feet.

4. A golf stance viewer as set forth in claim 3 wherein said supporting means has locating means so that the one part of said mounting body can be repositioned at the same desired position time after time.

5. A golf stance viewer as set forth in claim 1 wherein said reflective device has two lines spaced apart which can be aligned to properly align the reflective device with an object to be reflected.

6. A golf stance viewer as set forth in claim 1 wherein said mounting body has an enlarged portion containing said lens means, and has a hand held member extending from the side of the enlarged portion so that the golfer can place the lens means at its desired position.

7. A golf stance viewer as set forth in claim 6 wherein said enlarged portion is circular.

8. A golf stance viewer as set forth in claim 6 wherein said reflective device is supported by said mounting body where it can be seen by the golfer at the same time as said lens means.

9. A golf stance viewer as set forth in claim 8 wherein said reflective device is a prism, and means for fixing said prism to said mounting body.

10. A golf stance viewer as set forth in claim 9 wherein said hand held member includes a grip portion, said hand held member having a notch between said lens means and said grip portion for receiving said reflective device.

11. A golf stance viewer as set forth in claim 1 wherein said indicating means are feet indicating lines on said lens means.

12. A golf stance viewer as set forth in claim 1 wherein said indicating means includes a transparent plate aligned with said lens means, said feet indicating lines being on said transparent plate.

13. A golf stance viewer as set forth in claim 12 wherein said transparent plate is removable.

14. A golf stance viewer as set forth in claim 1 wherein said reflective device has an objective surface and a viewing surface, each surface having a viewing line which when aligned with each other and a desired object to be aimed at as viewed through the viewing surface said mounting body is directionally positioned.

15. A golf stance viewer as set forth in claim 1 wherein said lens means allows a golfer to look through said lens means and view his feet and golf ball to be hit, said indicating means including a ball indicating mark which is viewed with the golf ball, said ball indicating mark indicating ball placement with respect to feet placement so that ball placement can be repeated.

16. A golf stance viewer including a mounting body, said mounting body having lens means therein to allow a golfer to look through said lens means and view his feet and a golf ball to be hit, said mounting body having a reflective device to aim in a desired direction away from said golfer while said lens means is positioned to view the golfer's feet and golf ball, an indicating means comprising stance indicating lines so that as the golfer looks through said lens means said stance indicating lines are viewed with the golfer's feet and golf ball to be hit, said stance indicating lines indicating foot placement in relation to a golf ball to be hit so that a stance can be repeated.

* * * * *